US007109840B2

(12) United States Patent
Turner et al.

(10) Patent No.: US 7,109,840 B2
(45) Date of Patent: Sep. 19, 2006

(54) PROTECTOR FOR ELECTRICAL APPARATUS

(75) Inventors: Derek H. Turner, East Providence, RI (US); Michelle Pisuk, Waltham, MA (US); Karl A. Kohm, Cranston, RI (US)

(73) Assignee: Sensata Technologies, Inc., Attleboro, MA (US)

( * ) Notice: Subject to any disclaimer, the term of this patent is extended or adjusted under 35 U.S.C. 154(b) by 315 days.

(21) Appl. No.: 10/854,831

(22) Filed: May 27, 2004

(65) Prior Publication Data

US 2005/0264390 A1 Dec. 1, 2005

(51) Int. Cl.
*H01H 37/54* (2006.01)
*H01H 37/14* (2006.01)
*H01H 37/64* (2006.01)

(52) U.S. Cl. ..... 337/377; 337/362; 337/365

(58) Field of Classification Search ..... 337/362, 337/365, 377
See application file for complete search history.

(56) References Cited

U.S. PATENT DOCUMENTS

| | | | | | |
|---|---|---|---|---|---|
| 2,707,738 | A | | 5/1955 | Weissheimer et al. | |
| 2,991,341 | A | * | 7/1961 | Herman | 337/375 |
| 3,140,370 | A | * | 7/1964 | Harper, Jr. | 337/86 |
| 3,330,926 | A | | 7/1967 | Beckmann | |
| 3,470,514 | A | * | 9/1969 | Harper, Jr. | 337/89 |
| 3,753,195 | A | | 8/1973 | Woods | |
| 3,833,873 | A | * | 9/1974 | Moksu | 337/85 |
| 4,236,135 | A | * | 11/1980 | Holden | 337/89 |
| 4,237,510 | A | * | 12/1980 | Thompson et al. | 361/24 |
| 4,287,499 | A | * | 9/1981 | Pejouhy | 337/97 |
| 4,555,686 | A | * | 11/1985 | Pejouhy et al. | 337/102 |
| 4,646,195 | A | * | 2/1987 | Lisauskas | 361/25 |
| 4,866,408 | A | | 9/1989 | Petraitis et al. | |
| 5,023,744 | A | * | 6/1991 | Hofsass | 361/26 |
| 5,973,587 | A | * | 10/1999 | Hofsass | 337/377 |
| 6,005,471 | A | * | 12/1999 | Higashikata et al. | 337/347 |
| 6,054,916 | A | * | 4/2000 | Hofsass | 337/344 |
| 6,639,502 | B1 | * | 10/2003 | Herrick | 337/102 |
| 6,724,293 | B1 | * | 4/2004 | Hofsass | 337/365 |

FOREIGN PATENT DOCUMENTS

GB 2088132 A * 6/1982

* cited by examiner

*Primary Examiner*—Anatoly Vortman
(74) *Attorney, Agent, or Firm*—Russell E. Baumann

(57) ABSTRACT

A protector (10) particularly useful for wye-connected three phase electrical motors has a header (12) mounting first and second terminal pins (14) to which L-shaped pin heaters (16) are mounted along with stationary electrical contacts (16*b*). A generally U-shaped heater and support member (18) has two leg ends welded to the header intermediate to the terminal pins and a snap acting thermostatic disc (20*a*) is welded through a weld slug to the central portion of the heater and support member. First and second movable electrical contacts (20*b*) are mounted on the bottom surface of the thermostatic disc positioned to move into and out of engagement with respective stationary contacts upon snapping of the thermostatic disc from one dished configuration to an opposite dished configuration in dependence on temperature of the disc. A cover (24) is hermetically attached to the header and is provided with a force application location aligned with the weld slug which can be depressed against the weld slug and thereby adjust the operating temperature of the thermostatic disc.

10 Claims, 3 Drawing Sheets

PROTECTOR FOR ELECTRICAL APPARATUS

FIELD OF THE INVENTION

This invention relates generally to temperature responsive switches and more particularly to hermetic electrical switches to protect polyphase motors and the like from over-temperature conditions.

BACKGROUND OF THE INVENTION

It is known to provide protection for polyphase motors by placing a protector in heat conductive relationship with the windings of such motors using a snap acting thermostatic disc mounting electrical contacts which are adapted to move from a contacts closed position, engaged with respective stationary contacts in a normal circuit operational mode, to a contacts open position, disengaged from the stationary contacts upon the occurrence of selected elevated temperature conditions when the disc snaps from one dished configuration to an opposite dished configuration.

In U.S. Pat. No. 4,866,408, a protector is shown and described in which a pair of terminal pins extend through glass beads in a header plate. Each terminal pin mounts an end of a respective elongated strip heater that extends further away from the header plate and each strip heater mounts a respective stationary contact at the free end thereof. A rigid support member, attached to the header plate intermediate to the terminal pins, extends from the header plate and mounts a third heater which extends back toward but short of the header plate. A thermostatic snap acting disc is cantilever mounted to the free end of a third heater, the disc extending back over the third heater and mounting two movable electrical contacts adapted to move into and out of engagement with the stationary contacts. The switch is calibrated by adjustment of screws to vary the vertical position of the stationary contacts, as desired. Following calibration, a cover member is disposed over the switch mechanism and is hermetically attached to the header plate.

Although the above described switch is widely used, inexpensive and very effective, there is a need to provide a smaller switch and one which is reliable and even less expensive.

It is an object of the present invention to provide a protector particularly useful for polyphase motors, e.g., three phase motors, such as those used in scroll compressors, which is smaller than the prior art protector noted above yet which is reliable and inexpensive to make. Another object of the invention is the provision of a motor protector particularly useful for three phase motors having wye-connected windings which is smaller than conventional protectors yet one, despite having decreased thermal mass, has an optimum off time for ultimate trip conditions. Another object of the invention is the provision of a motor protector having a low profile with respect to the height of the protector relative to the header thereof without having the need for separate arc shielding ceramic pieces common in the prior art for protecting the glass mounting the terminal pins of the header.

SUMMARY OF THE INVENTION

Briefly described, the invention comprises a header plate having spaced apart first and second terminal pins extending through glass beads in bores formed through the header plate. A generally L-shaped, relatively rigid, heater plate is welded to each pin and provided with a stationary electrical contact at the free end thereof spaced sufficiently above the face surface of the header plate to obviate the need for ceramic arc shields and the like. A generally U-shaped center heater having opposed legs extending from a central bight portion has the free ends of the legs thereof welded to the header plate intermediate to the two terminal pins. A thermostatic, snap acting disc has a portion of a weld slug extending through an opening formed in the center of the disc which is welded to the bight portion of the center heater and first and second movable electrical contacts are mounted on the lower face of the disc generally in alignment with the stationary contacts and are adapted to move into and out of engagement with the respective stationary contacts upon the occurrence of the disc changing from one dished configuration to an opposite dished configuration at selected temperature conditions. A dish shaped cover is received over the switch mechanism and is welded thereto along its periphery to form a hermetic switch enclosure. The device is calibrated by deforming the cover at a single force application location in alignment with the weld slug. Preferably, a piece of electrically insulating material is placed between the cover and the weld slug whereby current is directed from the header plate through the center heater rather than through a dual path which includes the cover. The insulating material helps to extend the off time by limiting heat sinking from the disc to a path primarily through the center heater to the header plate.

BRIEF DESCRIPTION OF THE DRAWINGS

Other objects, advantages and details of the protector made in accordance with the invention appear in the following detailed description of the preferred embodiments of the invention, the detailed description referring to the drawings in which.

DETAILED DESCRIPTION OF PREFERRED EMBODIMENT

Figure 1:
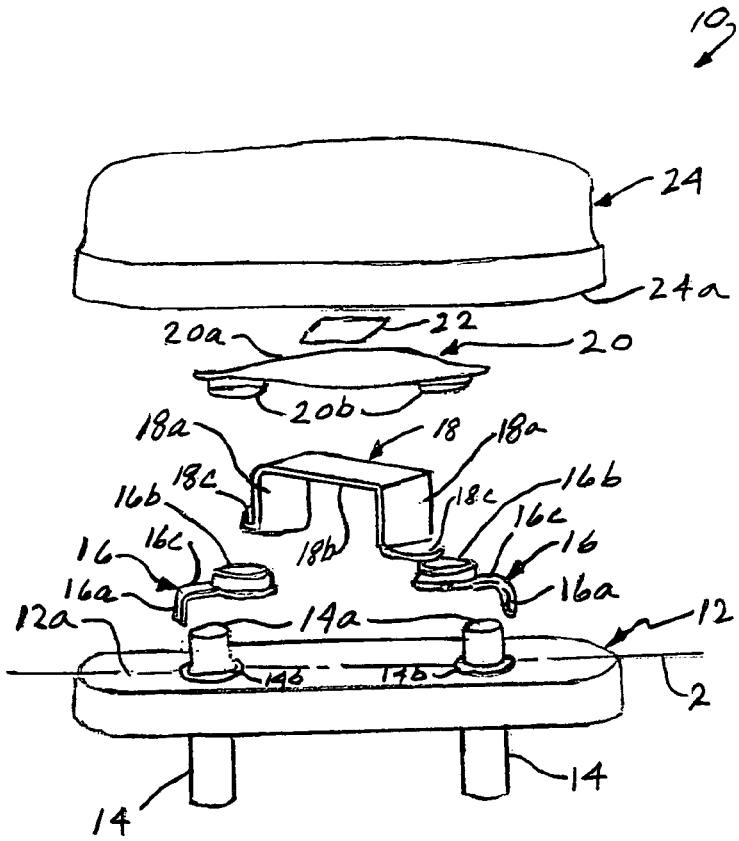
FIG. 1 is a blown apart perspective view showing the components, in a somewhat simplified form, of a protector made in accordance with the invention.

With reference to FIG. 1, a protector 10, particularly adapted for use with wye-connected three phase motors, and shown in somewhat simplified form, comprises a header plate 12 mounting first and second terminal pins 14 extending through glass material **14*b* in respective spaced apart bores in the header plate. Each terminal pin has a free end 14*a* spaced a selected distance from a generally planar face surface 12*a* of the header plate. A generally L-shaped, relatively rigid, heater 16 formed of any suitable heater material, has one leg 16*a* suitably connected to the outer cylindrical surface of a respective terminal pin 14 as by welding thereto and a stationary electrical contact 14*b*** mounted on second leg 16*c* arranged to lie in a plane generally parallel to face surface 12*a* of the header plate.

A third heater, center heater 18, is generally U-shaped having opposed legs 18*a* formed with a bight or central portion 18*b*. A foot 18*c* is formed at the free end of each leg 18*a* and is welded to face surface 12*a* of the header plate intermediate to terminal pins 14 with the center heater preferably oriented so that the bight extends along a line skewed relative to the longitudinal axis 2 of the header plate to facilitate the welding procedure of the heater to the header plate.

Figure 2:
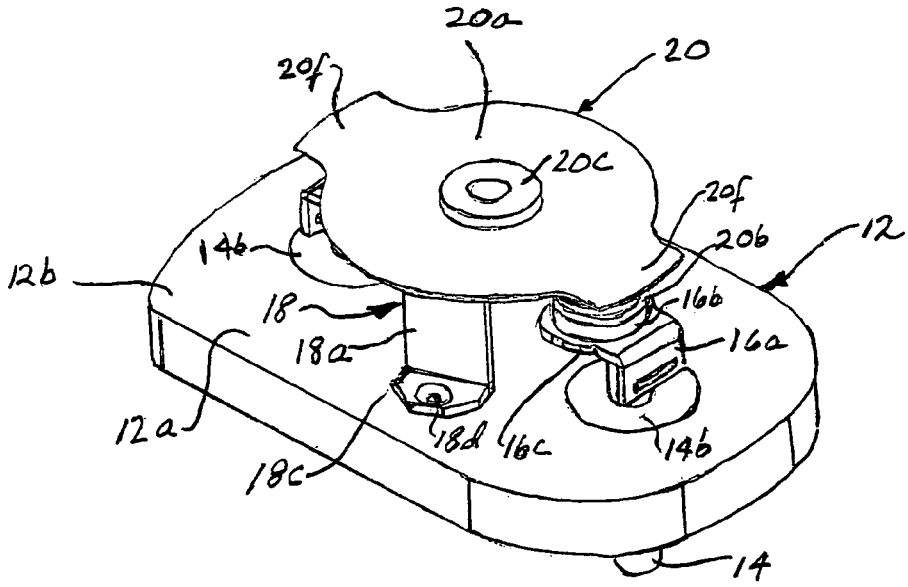
FIG. 2 is a perspective view of a protector made in accordance with the invention shown in greater detail with the cover removed for purposes of illustration.

A switch assembly 20 comprises a thermostatic, snap acting disc 20*a* which mounts first and second movable electrical contacts 20*b* on the bottom surface thereof, as shown in FIG. 1, spaced from one another to match the spacing of the stationary contacts 16*b*. As will be discussed in greater detail below, a weld slug 20*c*, as shown in FIG. 2, is attached to the center of the disc 20*a* and is used to attach the disc to bight 18*b* of center heater 18 with the movable contacts 20*b* aligned with respective stationary contacts 16*b*.

A piece of electrical insulation, such as a piece of Kapton tape 22, is preferably attached to the top surface of weld slug 20*c*, for a purpose to be discussed below, and then a dished cover 24 is hermetically attached to header plate 12 as by welding the cover to the header plate all along the peripheral edge 24*a* of the cover. Calibration is performed by depressing the top wall of cover 24 which transfers motion to and deflects disc 20*a* to obtain the selected operating temperature.

Figure 3:
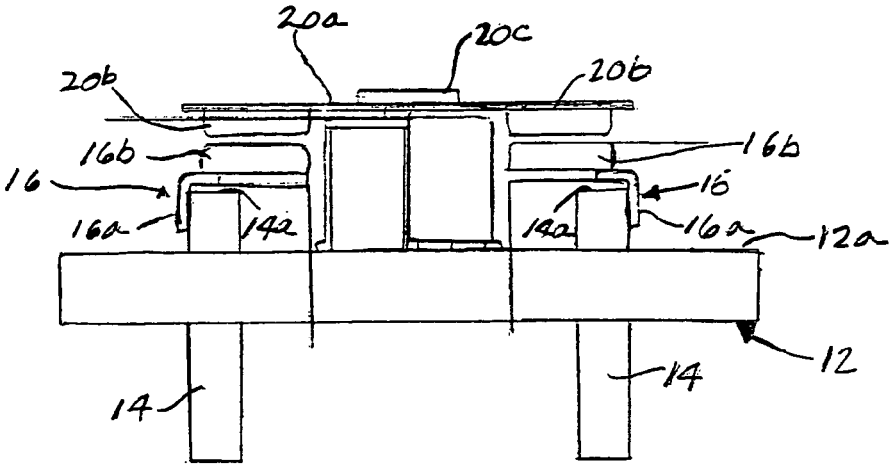
FIG. 3 is a front elevational view of the FIG. 2 structure.
Figure 4:
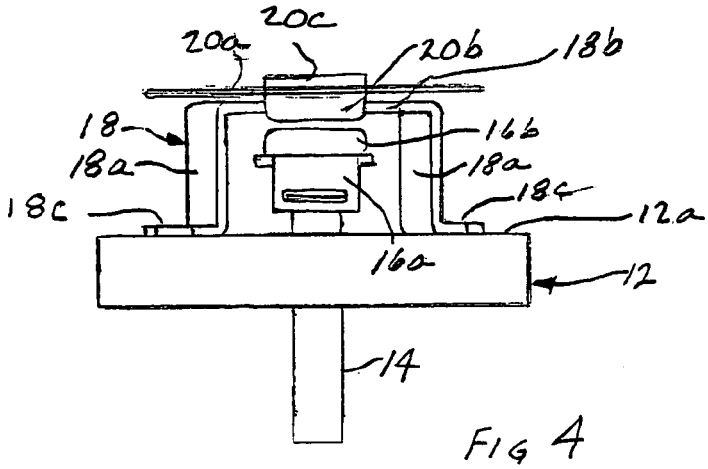
FIG. 4 is a right end elevational view of the FIG. 2 structure.
Figure 5:
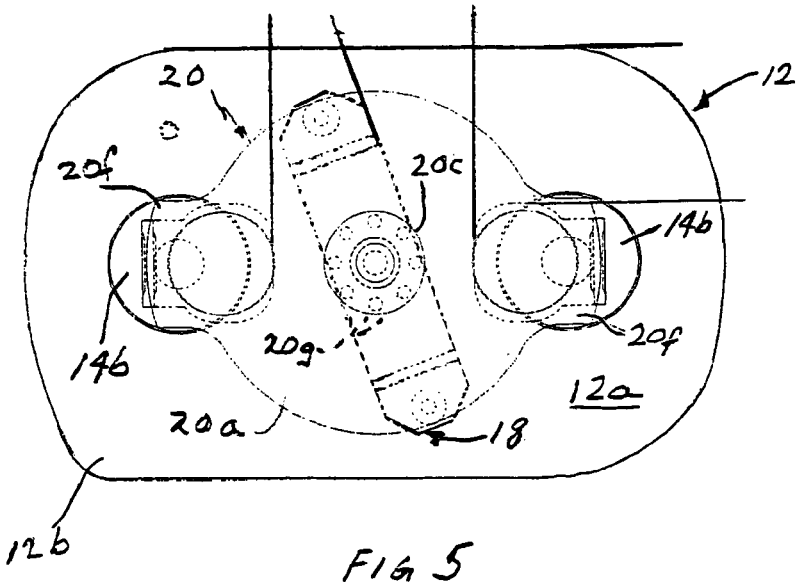
FIG. 5 is a top plan view of the FIG. 2 structure.
Figure 6:
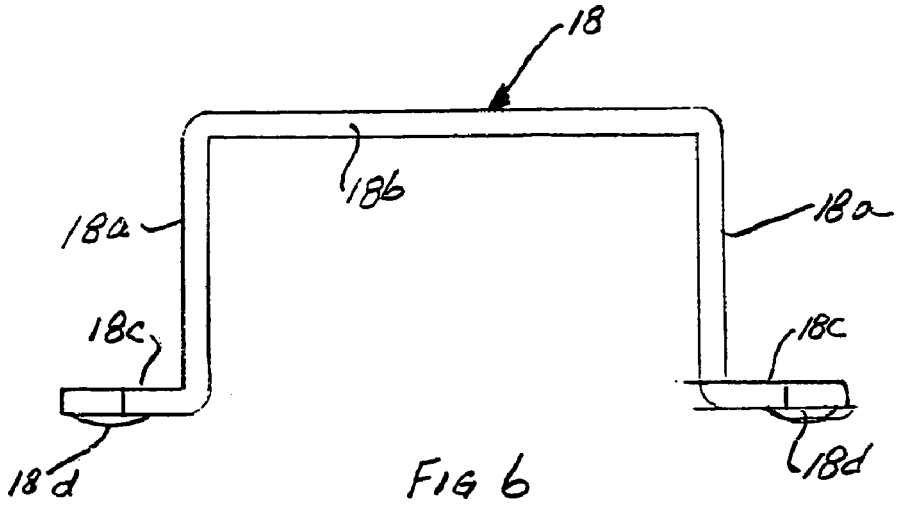
FIG. 6 is an enlarged front elevational view of the center heater of the FIG. 2 protector.

With reference to FIGS. 2–7, it will be noted that header plate 12 is shown slightly non-symmetrical with the lower left hand corner 12*b*, as seen if FIG. 5, having a smaller radius than the other corners to provide an indexing configuration. If preferred, the outer configuration can be formed symmetrically as shown in FIG. 1. Terminal pins 14 are maintained electrically isolated from header plate 12 by means of glass material 14*b* best seen in FIGS. 1, 2 and 5. Feet 18*c* of center heater 18 are provided with weld projections 18*d*, as best seen in FIG. 6.

Figure 7:
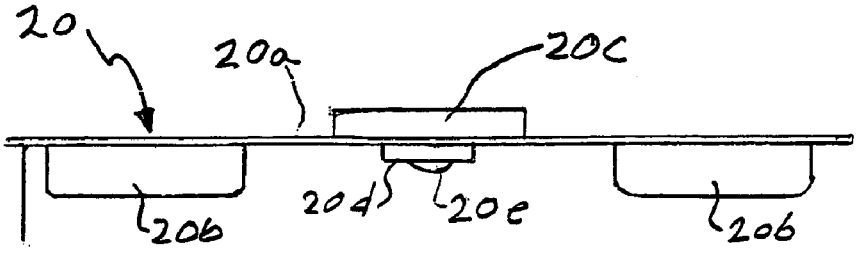
FIG. 7 is an enlarged front elevational view of the disc assembly of the FIG. 2 protector.
Figure 8:
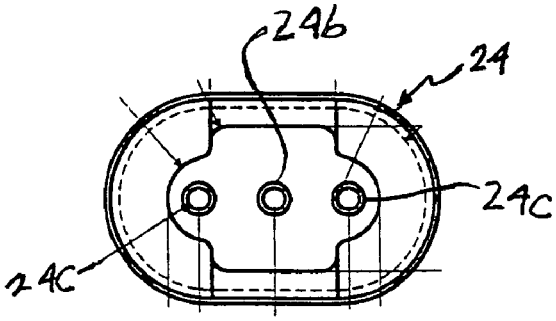
FIGS. 8 and 9 are reduced top plan and front elevational views of a cover for use with the FIG. 2 protector.
Figure 9:
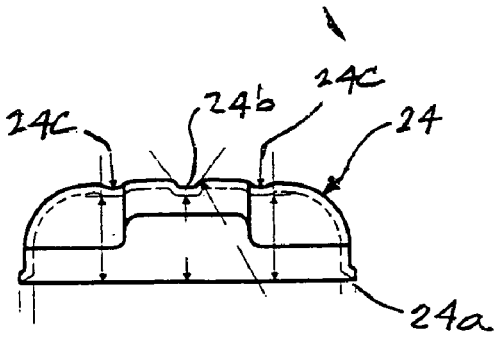

Disc 20*a* is generally circular in configuration and is formed with first and second opposed, outwardly extending ears 20*f* with the movable contacts attached to the disc, at least partially, at the ears. The disc is provided with a centrally disposed opening through which spacing hub portion 20*d* and center heater weld projection 20*e* extend (FIG. 7). Hub portion 20*d* provides suitable vertical spacing, accommodating the dish shape of the disc for mounting the center of the dished snap acting disc to center heater 18 while providing clearance between the disc, per se, and the center heater. The disc is welded to the lower surface of weld slug 20*c* around the periphery of the centrally disposed opening as seen in dashed lines 20*g* in FIG. 5. During normal operation, disc 20*a* has an upwardly facing slightly convex configuration with movable contacts in engagement (not shown) with corresponding stationary contacts 16*b*; however, when the temperature of disc 20*a* increases to a first selected actuation temperature due to $I^2r$ and ambient heating, the disc snaps to an opposite, upwardly facing slightly concave configuration causing contacts 20*b* to move out of engagement with stationary contacts 16*a* as best seen in FIGS. 3 and 4. When the disc then cools off to a second, selected reset temperature, lower than the first temperature, the disc will then snap back to the upwardly convex dished configuration with the contacts in engagement.

Welding disc assembly 20 to the center heater 18 results in an effective, controlled heat sink in which heat generated by $I^2R$ heating during normal operation is conducted from the disc down to header plate 12 through the center heater, as well as through cover 24 following calibration, to be discussed. As noted above, in order to extend the off or reset time, a piece of insulating tape 22 may be placed on top of weld slug 20*c* so that, current is confined to a single path from header plate 12 through center heater 18 rather than a dual path which includes cover 24.

Cover 24 is preferably formed with a central downwardly extending force projection 24*b* which is aligned with weld slug 20*c* for use in calibrating the device. Downwardly projecting dimples 24*c* are aligned with the outer extremities of ears 20*f* of disc 20*a* and serve to limit travel of the disc in the contacts disengaging direction.

As noted briefly above, the arrangement of the L-configured pin heaters 16 enables the provision of sufficient space between the stationary contacts and glass 14*b* so that ceramic arc shields need not be employed thus obviating a typical problem in conventional protection having such shields. That is, a common failure mode of protectors having ceramic arc shields is the cracking of such ceramic shields upon mishandling and the like with the result of the existence of loose chips of ceramic in the switch chamber.

The electrical contacts and L-shaped pin heaters 16 serve as current paths for two phases of a wye-connected motor and the current path for the third phase is provided by center heater 18 welded to header plate 12 and to disc 20*a*. In addition, the weld connections of the disc to center heater 18 and the center heater to the header provide an optimum heat sink arrangement. Center heater 18 serves to heat up disc 20*a* during normal operation with the two running at comparable temperatures; however, when the disc reaches a higher temperature heat is then conducted from the disc through the center heater to the header plate which has a relatively large thermal mass. For example, in an ultimate trip condition where there is an elevated temperature external to the protector, the header temperature initially is typically significantly lower than that of the disc, e.g., 70° C. for that of the header while the disc may have an opening temperature of, e.g., 150° C. In this situation, even though current is still passing through the disc, heat is continually being sinked to the larger heat mass of the header assembly to thereby lower the disc temperature until the center heater finally reaches the opening temperature of the disc.

The protector is easily assembled by welding the pin heater to the pins of the header plate, then welding the center heater to the header plate followed by welding the disc assembly to the center heater. The cover is then welded to the header plate and finally the protector is calibrated by deflecting the force application projection 24*b* to obtain the selected operating temperature.

It should be understood that the preferred embodiment of the invention has been described by way of illustrating the invention but that the invention includes all modifications and equivalents of the disclosed preferred embodiment which fall within the scope of the invention.

What is claimed:

1. A motor protector comprising an electrically conductive header having a longitudinal axis and a generally planar top surface, the header having first and second terminal pins mounted in respective apertures along the longitudinal axis and being electrically separated from the header, the pins each having a free end spaced above the top surface of the header, first and second stationary electrical contacts supported on and electrically connected to the respective first and second terminal pins and lying in a plane generally parallel to the planar top surface of the header, an electrically conductive, snap acting thermostatic disc having a top and a bottom surface and a central portion, first and second movable electrical contacts mounted on the bottom surface of the thermostatic disc, an electrically conductive heater and support member having an end portion and a disc support portion, the end portion of the heater and support member welded to the header with the disc support portion spaced above the top surface of the header, the central portion of the snap acting thermostatic disc being mechanically and electrically connected to the disc support portion of the heater and support member and being in close thermal coupling therewith, the movable electrical contacts being disposed generally in alignment with and movable into and out of engagement with the respective stationary contacts in dependence upon the temperature of the thermostatic disc, and a dish shaped cover received over the header and being welded there to form a hermetic switch enclosure.

2. A motor protector according to claim 1 further comprising a weld slug welded to the central portion of the thermostatic disc and to the disc support portion of the heater and support member.

3. A motor protector according to claim 2 in which the heater and support member is generally U-shaped having first and second legs and a central bight portion, the disc support portion formed in the central bight portion and each leg has a free end portion welded to the header.

4. A motor protector according to claim 3 in which the first and second legs of the heater and support member are aligned with an imaginary line which is skewed relative to the longitudinal axis of the header.

5. A motor protector according to claim 1 in which the terminal pins each have a side wall surface and further comprising first and second generally L-shaped pin heaters, each pin heater having a first leg welded to the side wall surface of a respective terminal pin and the second leg mounting a respective stationary electrical contact.

6. A motor protector according to claim 1 in which the cover is formed with a force application protrusion extending toward the top surface of the header in alignment with the central portion of the thermostatic disc whereby sufficient downward deflection of the protrusion will cause downward deflection of the central portion of the thermostatic disc and change the effective operation temperature of the thermostatic disc.

7. A motor protector according to claim 6 further comprising a layer of electrical insulating material disposed between the force application protrusion of the cover and the central portion of the thermostatic disc.

8. A motor protector according to claim 2 in which the thermostatic disc has a generally circular periphery.

9. A motor protector according to claim 8 in which the thermostatic disc has first and second opposed ears extending outwardly from the circular configuration, the movable contacts being located at least partially at the ears.

10. A motor protector according to claim 9 in which the cover is formed with first and second dimple surfaces aligned with the outer portion of the ears, the dimpled surfaces serving as stop surfaces to limit motion of the thermostatic disc in the contacts disengaging direction.

* * * * *